US009174246B2

(12) United States Patent
Berdelle-Hilge

(10) Patent No.: US 9,174,246 B2
(45) Date of Patent: Nov. 3, 2015

(54) SORTING PLANT AND SORTING METHOD WITH TWO TYPES OF SORTING TERMINALS

(75) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/361,353

(22) PCT Filed: Sep. 13, 2012

(86) PCT No.: PCT/EP2012/067949

§ 371 (c)(1),
(2), (4) Date: May 29, 2014

(87) PCT Pub. No.: WO2013/079236

PCT Pub. Date: Jun. 6, 2013

(65) Prior Publication Data

US 2014/0284254 A1 Sep. 25, 2014

(30) Foreign Application Priority Data

Nov. 29, 2011 (DE) ..... 10 2011 087 370

(51) Int. Cl.

| | |
|---|---|
| ***B07C 3/08*** | (2006.01) |
| ***B07C 5/36*** | (2006.01) |
| ***B07C 3/02*** | (2006.01) |
| ***B07C 5/02*** | (2006.01) |
| *B07C 3/06* | (2006.01) |

(52) U.S. Cl.

CPC ... *B07C 5/36* (2013.01); *B07C 3/02* (2013.01); *B07C 3/082* (2013.01); *B07C 5/02* (2013.01); *B07C 3/06* (2013.01)

(58) Field of Classification Search

CPC ..... B07C 3/02; B07C 3/06; B07C 3/065; B07C 3/08; B07C 3/082; B07C 3/087; B07C 5/36; B07C 1/00; B07C 1/02

USPC ..... 209/583, 584, 900; 700/223–226

See application file for complete search history.

(56) References Cited

U.S. PATENT DOCUMENTS

| | | | | |
|---|---|---|---|---|
| 4,964,499 | A * | 10/1990 | Morikiyo et al. | 198/370.04 |
| 5,097,959 | A * | 3/1992 | Tilles et al. | 209/584 |
| 5,421,464 | A * | 6/1995 | Gillmann et al. | 209/584 |

(Continued)

FOREIGN PATENT DOCUMENTS

| | | |
|---|---|---|
| DE | 10305847 B3 | 8/2004 |
| DE | 10342463 B3 | 4/2005 |

(Continued)

*Primary Examiner* — Joseph C Rodriguez

(74) *Attorney, Agent, or Firm* — Laurence A. Greenberg; Werner H. Stemer; Ralph E. Locher

(57) ABSTRACT

A sorting plant and a sorting method sort objects according to a predefined sort criterion. The sorting plant has a plurality of transfer sites, a plurality of upper pick-up units which can be swiveled into a pick-up position and into a park position, and a plurality of lower pick-up units. The upper pick-up units are arranged in such a manner that the upper pick-up units are located between the transfer sites and the lower pick-up units when the upper pick-up units are swiveled into the park position. For each object to be sorted, one pick-up unit is automatically selected regardless of the sorting criterion value of the object. The object is first moved to a transfer site and then into or onto the selected pick-up unit.

13 Claims, 4 Drawing Sheets

(56) References Cited

U.S. PATENT DOCUMENTS

| | | | | |
|---|---|---|---|---|
| 5,718,321 | A * | 2/1998 | Brugger et al. | 198/359 |
| 6,662,925 | B2 * | 12/2003 | Franci | 198/370.05 |
| 7,112,756 | B2 * | 9/2006 | Hanson | 209/584 |
| 7,201,277 | B2 * | 4/2007 | Wilke | 209/44.4 |
| 7,343,219 | B2 | 3/2008 | Berdelle-Hilge | |
| 7,493,189 | B2 | 2/2009 | Berdelle-Hilge et al. | |
| 7,683,284 | B2 | 3/2010 | Haselberger et al. | |
| 7,728,244 | B2 * | 6/2010 | De Leo et al. | 209/583 |
| 7,820,932 | B2 * | 10/2010 | Stemmle | 209/583 |
| 7,905,344 | B2 * | 3/2011 | Fritsche et al. | 198/704 |
| 8,035,053 | B2 | 10/2011 | Skrdlant et al. | |
| 8,230,141 | B2 | 7/2012 | Zimmermann | |
| 8,374,720 | B2 * | 2/2013 | Kechel | 700/224 |
| 8,983,648 | B2 * | 3/2015 | Kreitmeier et al. | 700/223 |
| 2005/0067331 | A1 | 3/2005 | De Leo et al. | |
| 2006/0102529 | A1 | 5/2006 | Wilke | |
| 2007/0022719 | A1 * | 2/2007 | Berdelle-Hilge | 53/437 |
| 2009/0211952 | A1 * | 8/2009 | Berdelle-Hilge | 209/552 |

FOREIGN PATENT DOCUMENTS

| | | | |
|---|---|---|---|
| DE | 10342464 | B3 | 4/2005 |
| DE | 102004033564 | B3 | 3/2006 |
| EP | 1500440 | A1 | 1/2005 |
| EP | 1894637 | A1 | 3/2008 |
| EP | 2011578 | A1 | 1/2009 |
| EP | 2322290 | A2 | 5/2011 |

* cited by examiner

SORTING PLANT AND SORTING METHOD WITH TWO TYPES OF SORTING TERMINALS

BACKGROUND OF THE INVENTION

Field of the Invention

The invention relates to a sorting plant and a sorting method with two types of sorting terminals which is able to sort a plurality of objects, in particular flat mail items.

FIG. 1 of EP 1500440 A1 discloses a "sorting and sequencing system" ("DPP system") 2, which is able to process three different types of flat mail items. Three "feed units 15a, 15b, 15c" for these three types bring mail items in "trucks 11". FIG. 4 shows a "truck 11" of this type having a plurality of "pockets 48", provided for one mail item each, and a dedicated drive 49m. The "trucks 11" are guided by a "conveyor system 9" along a path 13 and are transported by a dedicated drive 49m. The mail items in the "trucks 11" are transported along an "unloading portion 13s" of the path 13 and, from there, pass to an "accumulating device 20" which has a plurality of "accumulating units 59". FIG. 5 shows how a flat mail item 7 slides downwardly out of a "pocket 48" to reach an "accumulating unit 59" on a "conveyor belt 55". In one embodiment, an "accumulating unit 59" is formed by a "removable bin C" or a "cartridge K". In the embodiment of FIGS. 12a to 12d, a mail item initially slides downwardly out of a "truck 11" into a "trap unit 161". A pile of mail items is formed in each "trap unit 161". Later, two "rotary walls 172" are opened in the base of a "trap unit 161" and all the mail items slide downwardly out of the "trap unit 161" into an "accumulating unit 159". A plurality of stacks of mail items is generated sequentially in each "trap unit 161" and is output.

BRIEF SUMMARY OF THE INVENTION

It is an object of the invention to provide a sorting plant and a sorting method which can be used for different sorting tasks and/or for sorting various objects requiring sorting without this flexibility necessarily being achieved in that additional transfer sites are required for transferring objects to the sorting terminals.

The sorting plant according to the solution and the sorting method according to the solution enable a plurality of objects to be sorted according to a pre-determined sorting criterion. The sorting comprises the step of distributing the objects according to the sorting criterion among a plurality of pick-up units of the sorting plant. It is possible, but not required, that the objects are or will be sorted among themselves in a pick-up unit.

The sorting plant used comprises

- a measuring device,
- a selection unit,
- a plurality of selectable upper pick-up units,
- a plurality of selectable lower pick-up units,
- a set of transfer sites having a plurality of transfer sites,
- a holding device to which the selectable upper pick-up units are mechanically fastened,
- a set of pick-up units with the lower pick-up units,
- a conveying transport device, and
- a pick-up unit transport device.

For each object to be sorted, depending on the value that the sorting criterion assumes for this object, the selection unit automatically selects either an upper pick-up unit or a lower pick-up unit.

Each transfer site and each selectable pick-up unit is able, at times at least, to pick up at least one object to be sorted in each case, and preferably a plurality of objects simultaneously. Each upper pick-up unit can be pivoted back and forth between a pick-up position and a park position. Each selectable lower pick-up unit can be brought into a transfer position in relation to each transfer site used if the upper pick-up units are situated in the park position.

Each selectable upper pick-up unit is mechanically connected to the holding device in a pivotable manner. The upper pick-up unit can be pivoted into the park position and into the pick-up position. In the park position, the upper pick-up unit frees the route from the transfer sites to the lower pick-up units. In the pick-up position, the upper pick-up unit is able to pick up at least one object to be sorted. In one embodiment, the step of pivoting an upper pick-up unit into a position involves the step of displacing the upper pick-up unit linearly or of rotating said pick-up unit about a pivot axis and overlaying displacement and rotation.

In the pick-up position, an upper pick-up unit is arranged between the transfer sites and the lower pick-up units. Each upper pick-up unit can be brought into a transfer position in relation to each transfer site. An object to be sorted can be brought from a transfer site to a selected upper pick-up position if the upper pick-up unit is in the pick-up position and in the transfer position in relation to said transfer site.

An object to be sorted can at least be brought from the transfer site into a selected lower pick-up unit, when all the upper pick-up units are in the park position and the lower pick-up unit is in the transfer position in relation to this transfer site.

It is possible that the object can be brought out of a transfer site into the lower pick-up unit if

- some upper pick-up units are in the pick-up position and
- some other upper pick-up units are in the park position and
- no upper pick-up unit blocks the way from the transfer site to the lower pick-up unit.

For each object to be sorted, the following steps are carried out:

- the measuring device measures the value that the pre-determined sorting criterion assumes for this object.
- for this object, depending on the measured sorting criterion value, the selection unit automatically selects a selectable pick-up unit, specifically either an upper pick-up unit or a lower pick-up unit.
- the conveying transport device brings the object into or onto a transfer site.
- the selected pick-up unit is brought into a transfer position in relation to the transfer site with the object. If the selected pick-up unit is already in the transfer position, then it remains in this transfer position. If necessary, the selected pick-up unit is moved relative to the transfer site. It is also possible to move the transfer site.
- the object is brought out of the transfer site into the selected pick-up unit. It is possible for a plurality of objects to be brought at the same time from the same transfer site onto or into the same pick-up unit.

If an upper pick-up unit has been selected, this upper pick-up unit is already in the pick-up position or is brought into the pick-up position and then the object passes from the transfer site into the upper pick-up unit. If a lower pick-up unit has been selected, at least all the upper pick-up units which are situated between the transfer site and the selected lower pick-up unit in the transfer position are pivoted into the park position or remain in the park position so that the route from the transfer site to the selected lower pick-up unit is free. An object to be sorted is therefore initially brought to a transfer site and then passes from this transfer site either into an upper pick-up unit or into a lower pick-up unit.

Thanks to the invention, the sorting plant according to the solution can be operated optionally in an upper mode or in a lower mode. In the upper mode, only upper pick-up units are used and all the upper pick-up units used for sorting are in the pick-up position. In the lower mode, only lower pick-up units are used and the upper pick-up units are in the park position.

The sorting plant according to the solution can be operated, particularly initially, in the lower mode, the upper pick-up units being situated in the park position. Some or all of the lower pick-up units are filled with objects. Subsequently, the upper pick-up units are pivoted into the pick-up position and the sorting plant is operated in the upper mode. Thanks to the invention, on switching from the lower mode to the upper mode, the only step that needs to be carried out is that of pivoting the upper pick-up units, but specifically not the step of emptying the lower pick-up units before the upper pick-up units are filled. Furthermore, during sorting, a pick-up unit does not need to be supplemented.

The invention enables the upper pick-up units to be tailored to a first sorting task or a first type of object to be sorted and the lower pick-up units to be tailored to a second sorting task or a second type of object. The two types of object differ in at least one physical feature, for example, a dimension, the contour or the weight. When the sorting plant is configured, the upper pick-up units and the lower pick-up units can be tailored, largely independently of one another, to the sorting task for which these pick-up units are to be used. Thanks to the invention, the same sorting plant can be used for both sorting tasks or for both types of object. Thanks to the invention, the two sorting tasks can be carried out chronologically overlapping.

According to the solution, each upper pick-up unit can be pivoted into a pick-up position and into a park position. If the upper pick-up units are each situated in the respective park position, an object to be sorted can be brought from a transfer site past the upper pick-up units or between two upper pick-up units into a selected lower pick-up unit. From the same transfer site, a first object can thus be passed to an upper pick-up unit and after, or before, a pivoting movement of said upper pick-up unit, a second object can be brought into a lower pick-up unit. In particular, it is made possible that, due to the gravitational force, the object slides down out of the transfer site into the selected lower pick-up unit.

If an upper pick-up unit has been selected and this selected upper pick-up unit is in the pick-up position, the object can be brought out of said transfer site into said upper pick-up unit. It is made possible, in particular, for the object to slide from above onto the upper pick-up unit.

The invention therefore saves transfer sites because the same transfer sites can be used both for loading the upper pick-up units and for loading the lower pick-up units. In particular, a double set of transfer sites, specifically a set for the upper pick-up units and a set for the lower pick-up units, is not needed.

The transfer sites enable the sorting plant to sort for more different sorting criterion values than a sorting plant without transfer sites, specifically without additional pick-up units being needed and without a pick-up unit having to be emptied during sorting. This can be achieved, in particular, as follows: The selection unit selects the same pick-up unit for a plurality of objects with different sorting criterion values. These objects are distributed among different transfer sites, depending on their respective sorting criterion values. The different transfer sites are then emptied into the same selected pick-up unit in a particular sequence.

Thanks to the invention, it does not yet need to be known which pick-up unit is selected for an object while the object is being transported to a transfer site. As a result, more time is available for measuring the sorting criterion value of the object. Even if the object is already in or on a transfer site, the pick-up unit does not yet need to have been selected. The object to be sorted can remain in the transfer site for as long as a pick-up unit has been selected for this object. Thanks to the invention, it is possible, but not necessary to use different types of transfer site. Rather, because each upper pick-up unit can be pivoted into a pick-up position and into a park position, a single type of transfer site is sufficient.

The invention also enables another operating mode in which for each object to be sorted, depending on the sorting criterion value, initially a pick-up unit is selected and then, depending on the selected pick-up unit, a transfer site is selected. The transfer site can be selected, for example, such that the transport route to the selected transfer site is short.

A sorting plant according to the solution for flat mail items as the objects to be sorted can be realized, for example, in that a known sorting plant for large letters is supplemented with the pivotable upper pick-up units. The pick-up units already present, for example, placement sites for containers where containers for objects to be sorted are situated function as the lower pick-up units. A sorting plant of this type is, for example, the "Open Mail Handling System (OMS)", which is described in DE 10342463 B3, DE 10342464 B3, DE 10305847 B3, DE 102004033564 B3 and EP 2011578 A1.

According to the solution, a lower pick-up unit is situated—seen in the direction in which the objects to be sorted are brought into this pick-up unit—effectively in the shadow of the upper pick-up units when the upper pick-up units are situated in the pick-up position. This embodiment leads to a reduced space requirement relative to an embodiment in which the upper pick-up units and the lower pick-up units are arranged adjoining one another such that an object can be brought out of a transfer site at a time point optionally both into an upper pick-up unit and also into a lower pick-up unit. It is made possible also, where the space requirement is reduced, to realize fixed-location transfer sites.

If all the upper pick-up units are situated in the park position, an object to be sorted is brought past the upper pick-up units into a selected lower pick-up unit. An object passes into a selected upper pick-up unit if this upper pick-up unit is in the pick-up position. An object therefore passes out of a transfer site either into an upper pick-up unit or into a lower pick-up unit, but not out of an upper pick-up unit into a lower pick-up unit. The upper pick-up units are therefore sorting terminals, not intermediate stores and also not buffer stores, such as are described in EP 1500440 A1.

According to the solution, an object to be sorted is initially brought to a transfer site and from there is brought into the selected pick-up unit. This embodiment markedly increases the storage capacity of the sorting plant as compared with an embodiment wherein the objects are brought directly into the respective selected pick-up unit. The transfer sites function as buffer stores of the sorting plant and these buffer stores even out a varying chronological pattern in the number of objects fed in and to be sorted per time unit.

Thanks to the invention, it is not necessary for the following two processes to be synchronized with one another:

- the process of transporting an object to be sorted, to the transfer site, with
- the process of bringing the selected pick-up unit into a transfer position in relation to this transfer site.

Thanks to the invention, the same transfer site can be used both to pass an object from this transfer site into a previously selected upper pick-up unit and also to pass said object from said transfer site into a previously selected lower pick-up unit. It is not necessary to provide different transfer sites for upper pick-up units and lower pick-up units. By this means, the advantage of being able to use a single sorting plant with different pick-up units can be achieved without additional transfer sites being necessary. This saves space ("footprint") and simplifies the conveying transport device. This conveying transport device can be tailored to a single type of transfer site. On average, an object is transported over a shorter transport route.

Preferably, a maximum pick-up capacity is pre-defined for the upper pick-up units. As a measure of the pick-up capacity, for example, the number of objects in or on the pick-up unit, a total thickness or another total of dimensions or the total weight of all the objects in or on the pick-up unit is used. The actual pick-up capacity of each upper pick-up unit is smaller than or equal to this pre-determined maximum pick-up capacity. An upper pick-up unit is filled only to this actual pick-up capacity. The pick-up capacity of each lower pick-up unit is preferably greater than this maximum pick-up capacity of the upper pick-up units. Since the lower pick-up units are thus larger than the upper pick-up units, it is made possible to configure the upper pick-up units smaller and/or lighter then the lower pick-up units. This, in turn, facilitates pivoting the upper pick-up units out of the park position into the pick-up position and vice versa, particularly since a smaller mass needs to be moved and less space is required for pivoting.

In one embodiment, the sorting plant has more upper pick-up units than lower pick-up units. As a result, more upper pick-up units are available for selection than lower pick-up units. Preferably, at least one or even every upper pick-up unit is configured as a type of tray and comprises a support element and at least one stop wall.

Preferably, the step of pivoting the upper pick-up unit out of the pick-up position into the park position or vice versa comprises the step of rotating the support element about a rotation axis. This rotation axis can be arranged perpendicularly or horizontally.

In a development of this embodiment, at least one upper support element is configured planar and obliquely inclined. An object received thereon slides downwardly under gravity on the selected planar support element until the object is stopped by the stop wall. This embodiment has the result that the object has a defined position relative to the upper pick-up element, which facilitates orientation on the same selected upper pick-up unit of a plurality of objects to be sorted without an image recording device and an actuator having to be used for the orientation.

In one embodiment, the upper pick-up units are transported along a conveying path. Every flat pick-up element is inclined—seen in the transport direction—obliquely such that an object on the support element slides forwardly. The "movement wind" during transporting of the support element presses the object onto the support element and does not lift the object.

If the upper pick-up unit is in the pick-up position, an object received thereon lies on the support element and slides obliquely downwardly as far as the stop wall. This embodiment makes possible a particularly light upper pick-up unit which can be pivoted rapidly. The upper pick-up unit requires only little space so that little space is required also for the upper pick-up unit in the park position. The pick-up unit can be markedly flatter, that is, it can have less height than an object to be sorted which has been received thereon.

In one embodiment, an upper pick-up unit can be pivoted through a rotation out of the park position into the pick-up position and can be pivoted back again through a contrary rotation. In another embodiment, the rotation axis of both these rotations extends horizontally so that an upper pick-up unit is pivoted in the manner of a cinema seat from the pick-up position into the park position. This embodiment has the result that the upper pick-up unit occupies little space in the park position. In another embodiment, the rotation axis extends vertically. This embodiment requires only a little energy to pivot the upper pick-up unit.

In another embodiment, this pivoting is carried out by a linear movement with the aid of a guide device.

In one embodiment, each upper pick-up unit has a dedicated drive which is able to pivot the upper pick-up unit out of the park position into the pick-up position and back from the pick-up position into the park position. In another embodiment, the upper pick-up units are guided by the pick-up unit transport device along a guide device having a plurality of guide rails. The upper pick-up units have no dedicated drive. The transport of an upper pick-up unit along the guide device brings about restricted guidance with forced pivoting. By means of this restricted guidance, the upper pick-up unit is pivoted out of the park position into the pick-up position and back out of the pick-up position into the park position.

The guide device for the upper pick-up unit therefore has at least one park section in which all the upper pick-up units in this park section are in the park position and a pick-up section in which all the upper pick-up units are in the pick-up position. The restricted guidance brings about the transition from the park position into the pick-up position whilst the pick-up unit is transported from the park section into the pick-up section.

In a preferred embodiment, the upper pick-up units are situated in a central plane and the lower pick-up units are situated in a lower plane beneath the central plane. The transfer sites are located in an upper plane above the central plane. An object slides out of a transfer site due to gravity, vertically or obliquely downwardly into or onto the selected pick-up unit. If the upper pick-up units are situated in the park position, the objects slide or fall past the upper pick-up units or between two respective upper pick-up units downwardly into or onto the lower pick-up units. This embodiment saves a conveying component, which brings an object to be sorted from the transfer site to the selected pick-up unit.

It is also possible for the transfer sites, the upper pick-up units and the lower pick-up units to be located in one plane, the upper pick-up units being located in the pick-up position between the transfer sites and the lower pick-up units. This one plane can be horizontal or obliquely inclined.

In one embodiment, the transfer sites are movable and can therefore be moved relative to the pick-up units. The step of bringing a pick-up unit into a transfer position in relation to a transfer site comprises the step of moving the transfer site along a conveying path.

In another embodiment, the transfer sites are stationary, that is, configured as fixed-location devices. The step of moving a selected pick-up unit into a transfer position in relation to a transfer site comprises the step of moving the pick-up unit relative to the fixed-location transfer site.

The upper pick-up units can preferably be moved in a guiding direction, for example in that the upper pick-up units are guided along at least one rail. The pick-up unit transport device moves the upper pick-up units guided in this way. This embodiment removes the necessity of providing a dedicated drive for each upper pick-up unit. However, it is also possible for each upper pick-up unit to have a dedicated drive. The pick-up unit transport device also moves the lower pick-up units.

In one embodiment, at least one or even every lower pick-up unit comprises a placement site for a container. This placement site can be arranged locally fixed or can belong to the pick-up unit transport device. A container which receives at least one object to be sorted can be placed at each placement site. A filled container can be removed again from the placement site. The selection unit selects a placement site which belongs to the sorting plant and does not directly select a container which is interchangeable.

In another embodiment, each lower pick-up unit comprises a section of a horizontal endless conveying belt. For example, separating walls divide the conveying belt into these sections. The objects for which this lower pick-up unit has been selected slide from above or obliquely from the side to this section. The endless conveying belt belongs to the pick-up unit transport device and, in another embodiment, transports the objects from a plurality of sections one after another to a central pick-up unit. The objects arrive at this central pick-up unit sorted.

In one embodiment, the upper pick-up units move in a contrary manner to the lower pick-up units. The upper pick-up units are therefore moved in one transport direction and the lower pick-up units are moved in the contrary transport direction. This embodiment makes it possible, when a lower pick-up unit has been selected for an object, to bring the selected lower pick-up unit into a transfer position by means of a contrary movement and thereby to transport away upper pick-up units which are still in the pick-up position, instead of rotating or displacing them, which is sometimes quicker.

In one embodiment, the transfer sites move in a contrary manner to the upper pick-up units and/or to the lower pick-up units. This embodiment enables a transfer position to be created particularly rapidly.

In one embodiment, the conveying transport device brings an object to be sorted into the next available transfer site. This embodiment makes it possible to use a single type of transfer site.

In another embodiment, depending on the measured sorting criterion value, a transfer site is selected. This embodiment with the selection of a transfer site enables a plurality of objects with the same sorting criterion to be grouped into one transfer site, which saves transfer sites. Furthermore, it is made possible to shorten the transport route in order to bring a selected pick-up unit into a transfer position in relation to the transfer site.

It is made possible through the invention that the sorting plant has different transfer sites and selects a suitable transfer site for an object depending on a physical property of the object. It is therefore provided in this embodiment to use different transfer sites and, for each object to be sorted, to select a suitable transfer site depending on a physical property of the object. The physical property is, for example, a dimension or the weight of this object. The use of different transfer sites often saves space as compared with the use of a universal transfer site which is suitable for every object and is therefore often larger or heavier than is necessary for the object.

In one embodiment, the sorting plant according to the solution can be operated either in an upper mode or in a lower mode. The sorting plant is always in the upper mode, in the lower mode or, if required, in a maintenance mode. In the upper mode, all the upper pick-up units are in the pick-up position and the selection unit selects exclusively upper pick-up units for the objects to be sorted. In the lower mode, all the upper pick-up units are in the park position and the selection unit selects exclusively lower pick-up units. In this embodiment, the sorting plant can be transferred from the upper mode into the lower mode in that all the upper pick-up units are pivoted at once or at least in a continuous process from the pick-up position into the park position. It is also possible initially to operate the sorting plant in the lower mode and thus to fill the lower pick-up units, the upper pick-up units being in the park position, subsequently to operate the sorting plant in the upper mode and thereby to use the upper pick-up units which have been pivoted into the pick-up position and only then to empty both the upper pick-up units and the lower pick-up units. This embodiment saves an emptying process between the sorting in the lower mode and the sorting in the upper mode.

In another embodiment, at one time point, some of the upper pick-up units are situated in the pick-up position and can be selected, whilst other upper pick-up units are situated in the park position and therefore cannot be selected and free up the route from the transfer sites to the lower pick-up units. Therefore some of the lower pick-up units can be selected and filled with objects to be sorted. Following sorting, both some of the upper pick-up units situated in the pick-up position and also some of the lower pick-up units are filled with objects to be sorted.

In another embodiment, an object to be sorted is connected for a time to a holding component, preferably after the sorting criterion value of this object has been measured. The holding component is, for example, a pocket or a carrying tray or an arrangement with a clamp or a plurality of clamps. The holding component with the object is brought into a transfer position in relation to a transfer site and the object is released again by the holding component and is brought into the transfer site. This embodiment further increases the capacity of the sorting plant for the intermediate storage and buffering of objects. The holding components are preferably situated in a plane above the transfer sites so that an object can slide out of or from the holding component into the transfer site. The holding component or the transfer site or both are moved in order to reach the transfer position. In one embodiment, the holding components are always transported in the same transport direction along a closed conveying path.

In another embodiment, both the upper pick-up units as well as the lower pick-up units are transported along a conveying path in each case. The pick-up unit transport device moves the upper pick-up units and the lower pick-up units relative to the transfer sites.

At least one fixed-location sensor measures the current fill level in each upper pick-up unit, whilst the upper pick-up unit is transported past the sensor. At least one further fixed-location sensor measures the current fill level in each lower pick-up unit, whilst the lower pick-up unit is transported past the further sensor. Preferably, the sensors measure the current fill level optically or by other contactless means, for example, by measuring the distance from the objects in the pick-up unit. This embodiment dispenses with the necessity for equipping every pick-up unit with a dedicated local fill level sensor.

Preferably, the fill level in each pick-up unit is additionally predicted in that a dimension of each object is measured. The measured dimensions of all the objects for which the same pick-up unit has been selected are automatically totaled and provide a prediction value for the fill level. The measurement values of the fixed-location sensors provide correct values for checking. In one embodiment, the measured value from a fixed-location sensor is used as the starting value and the measured dimensions of all the objects which, following measurement by the fixed-location sensor, are output into or onto said pick-up unit are added to the measured value from the measured sensor until this pick-up unit is emptied again or until the sensor measures the fill level once again.

In another embodiment, the measured sorting criterion value of an object is a destination point to which said object is to be transported. On the way to the destination point, the object is transported together with other objects. Either the object itself is provided with an identification of this destination point. Or the object is provided with a clear identifier and the identifier is stored in a database together with the destination point identification. Or for the object, a destination point identification is selected from a pre-determined list with destination points and is assigned to the object as a sorting criterion value only during the transport.

In another embodiment, a physical property of the objects is used for sorting, for example, a dimension, the weight, the volume, a contour, a surface property or a color.

The invention will now be described by reference to an exemplary embodiment. In the drawings:

DESCRIPTION OF THE INVENTION

Figure 1:
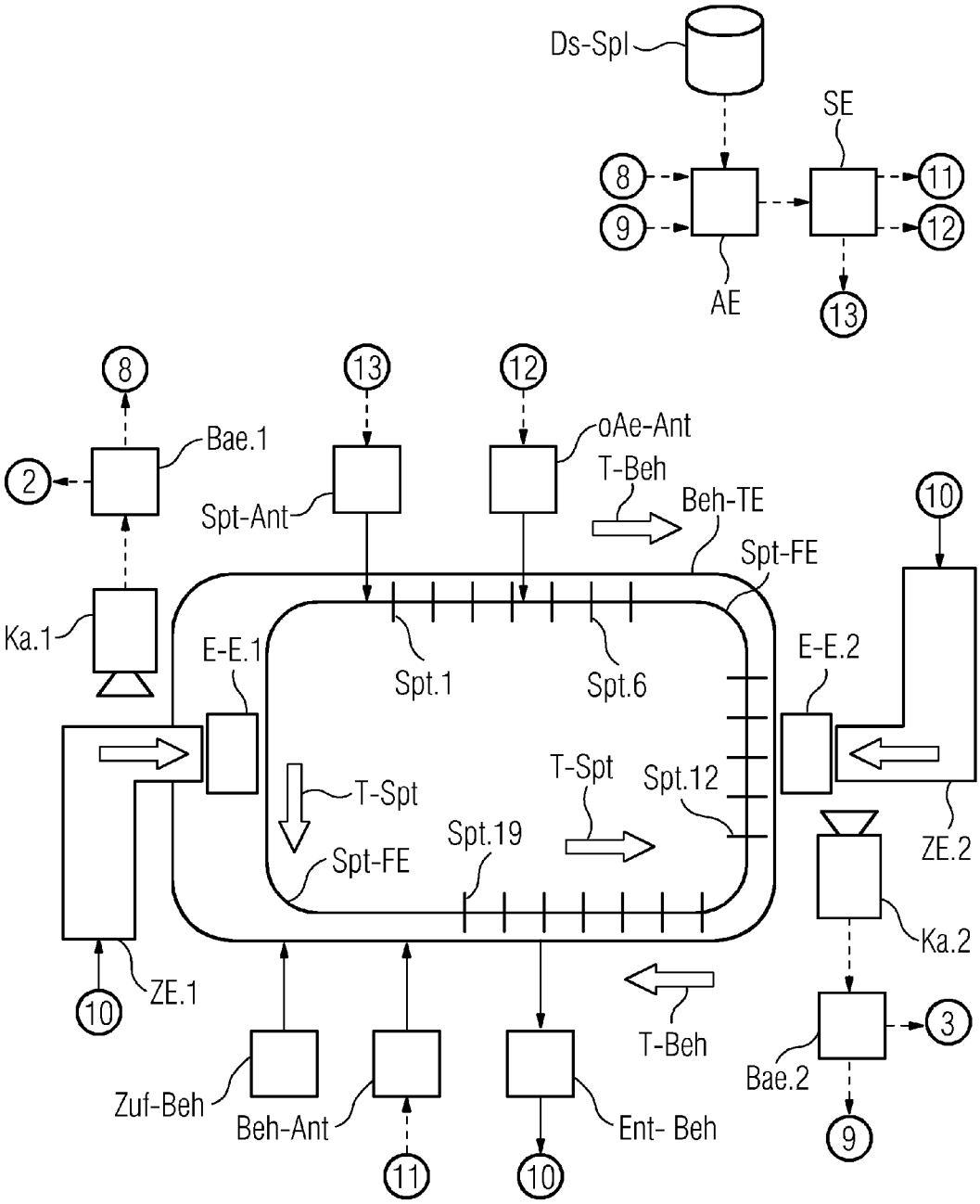
FIG. 1 is a schematic plan view of the sorting plant of the exemplary embodiment.

In the exemplary embodiment, the invention is used in order to sort flat mail items (standard letters, large letters, catalogues, postcards and possibly flat packages).

For each mail item, a postal delivery address is pre-determined. This postal delivery address comprises a recipient name and a postal destination point, for example, a particular house or a PO box or a package box. In another embodiment, a mail item is provided with an identification of this delivery address. In another embodiment, the geographical coordinates of the destination point of a mail item are applied to the mail item itself.

In another embodiment, a sender, for example, a printing house, passes a plurality of similar mail items which are not provided with identifications of delivery addresses to a transport service provider and also sends to a data processing system of this transport service provider an electronic list with delivery addresses for these still non-addressed mail items. The sorting plant according to the solution is able to sort addressed and non-addressed mail items at the same time and, in the process, to associate a delivery address from the list with every non-addressed mail item.

The transport service provider transports mail items to delivery addresses within a region of responsibility, for example, within a country. This region of responsibility is subdivided into w delivery regions W(1), . . . , W(w). A sorting center Sz(k) with at least one sorting plant is responsible for every delivery region W(k) (k=1, . . . , w). In the sorting center Sz(p0), which is responsible for the exemplary delivery region W(p0) (1≤p0≤w), a sorting plant according to the solution sorts incoming mail items. This delivery region W(p0) is subdivided into z=z(p0) delivery districts Z(1), . . . , Z(z), for example into z sections of delivery routes. For each delivery district Z(i) (i=1, . . . , z), in each case, a sequence among the postal destination points of this delivery district Z(i) is pre-defined. A postal deliverer ("carrier") walks or drives through this delivery district Z(i) according to this sequence in order to deliver the mail items to delivery addresses of this delivery district Z(i).

Furthermore, w1 regions of responsibility are pre-defined outside the region of responsibility of the transport service provider, for example, w1 regions in other countries.

Each mail item to be transported is handed over to the transport service provider in a receiving station, for example, a post office, a postal agency or a letterbox or a package box. A plurality of receiving stations belongs to the exemplary delivery region W(p0). The mail items which are delivered to these receiving stations are transported to the sorting center Sz(p0) which is responsible for the delivery region W(p0). The sorting plant according to the solution in the sorting center Sz(p0) carries out outgoing sorting for all the mail items that arrive at this sorting center Sz(p0) within a pre-determined time period of, for example, 24 hours. During said outgoing sorting, the sorting plant according to the solution divides the mail items among the w delivery regions W(1), . . . , W(w) and among the w1 external regions of responsibility without sorting the mail items among themselves for a delivery region. The mail items for the delivery regions W(k) (k=1, . . . , w) are transported to the sorting center Sz(k) which is responsible for the delivery region W(k). The mail items for the w1 external regions of responsibility are passed to other transport service providers.

The mail items which are delivered to a receiving station in the delivery region W(p0) and are to be transported to a delivery address in the same delivery region W(p0), remain in the sorting center Sz(p0) with the sorting plant according to the solution. Further mail items from other delivery regions arrive at the sorting center Sz(p0) once other sorting centers of the transport service provider have also carried out outgoing sorting to the w delivery regions.

The sorting plant according to the solution in the sorting center Sz(p0) now carries out incoming sorting and subsequent sequential sorting for the mail items arriving within a time period, to delivery addresses in the delivery region W(p0). The aim of the incoming sorting and of the sequential sorting is that after sorting, firstly, all the mail items are distributed among the z delivery districts Z(1), . . . , Z(z) of the delivery region W(p0) and, secondly, all the mail items of a delivery district Z(i) are sorted according to the pre-determined route sequence ("delivery sequence" or "carrier walk sequence") according to the destination points ("delivery points") of this delivery district.

In the incoming sorting process, the arriving mail items for delivery addresses within the delivery region W(p0) are distributed among the z delivery districts Z(1), . . . , Z(z) of the delivery region W(p0) without the mail items being sorted among themselves for a delivery district. In the exemplary embodiment, this distribution is also carried out by the sorting plant according to the solution, specifically immediately before the sequential sorting or chronologically overlapping with the sequential sorting. However, it is also possible for this incoming sorting to be carried out already during the outgoing sorting and for the mail items for the delivery region W(p0) to be transported to the sorting center Sz(p0) already sorted according to delivery districts.

During the outgoing sorting, the mail items are sorted to w+w1 different sorting destinations. During the incoming sorting, mail items are sorted to z different sorting destinations. The sorting plant according to the solution uses N sorting terminals. The sorting plant is configured such that N>=w+w1. Therefore, only one sorting run is carried out during the outgoing sorting. If N>=z, then a single sorting run is also sufficient for the incoming sorting. Otherwise, during the incoming sorting, the sorting plant according to the solution firstly subdivides the mail items into N relatively large subgroups, wherein each subgroup contains the mail items for a plurality of delivery districts in each case. Subsequently, the sorting plant divides each subgroup among the delivery districts ("tree sort").

However, in a sequential sorting procedure, in order to bring the mail items to the delivery addresses in a delivery district in a sequence according to the route, sorting must be carried out to significantly more sorting destinations (delivery addresses in the delivery district) than the sorting plant according to the solution has sorting terminals. Therefore in the sequential sorting, at least two sorting runs are carried out sequentially or chronologically overlapping. In two sorting runs, the sorting plant can sort to at least N*N sorting destinations if, in both the sorting runs, the same N sorting terminals are used and, in three sorting runs, to as many as N*N*N sorting destinations.

In another embodiment, for sequential sorting, the sorting plant according to the solution uses a version of the radix method, the principle of which will now be described for the case of two sorting runs. In each sorting run, N sorting terminals are used. What is pre-determined is a sequence among the sorting criterion values which occur (herein: destination points).

To each postal destination point of a delivery district Z(i0), the pre-determined sequence for this delivery district Z(i0) assigns a position number j. For M destination points of the delivery district Z(i0), the position number j is a number between 1 and M. Each sorting terminal used in the sorting plant also receives a position number i, where 1≤i≤N, in a sequence among the N sorting terminals. Each position number j is assigned a tuple (i1, i2) where 1≤i1, i2≤N such that i1*N+i2=j. This method assumes that N*N≥M.

In the first sorting run, a mail item, the destination point of which has the position number j=(i1, i2), is output to the sorting terminal i2. Following the first sorting run, next all the mail items from the sorting terminal No. 1 are fed back to the sorting plant and pass through the sorting plant in the second sorting run, followed by all the mail items from sorting terminal No. 2, and so on. In the second sorting run, a mail item, the destination point of which has the position number j=(i1, i2), is output to the sorting terminal No. i1. Following the second sorting run, firstly the mail items to the destination point (i1, 1) are then located in the sorting terminal No. i1, followed by the mail items to the destination point (i1, 2) and so on.

In the exemplary embodiment, an improvement of the radix method is used which enables sorting to more than N*N sorting terminals to be carried out in two sorting runs. The same sorting terminal is assigned to a plurality of destination points both in the first sorting run and in the second sorting run. At least in the second sorting run, the mail items with the same assigned sorting terminal are distributed, depending on their delivery addresses, to different intermediate stores of the sorting plant. The intermediate stores are emptied one after the other into the same assigned sorting terminal. Due to the sequence in which the intermediate stores are emptied, a sequence is generated among the mail items in a sorting terminal.

The sorting plant according to the solution comprises the following components in the exemplary embodiment (see FIG. 1):

- at least one conveying apparatus ("feeder") ZE.1, ZE.2, each having a separator ("singulator"),
- at least one measuring device having, in each case, a camera Ka.1, Ka.2 and an image evaluation unit Bae.1, Bae.2,
- a data store Ds-Spl having a plurality of computer-evaluatable sorting plans,
- a data-processing selection unit AE,
- a data-processing control unit SE,
- at least one feeding-in station E-E.1, E-E.2,
- a storage pocket transport device Spt-FE with a guide device and a plurality of storage pockets ("pockets") Spt.1, Spt.2, . . . , without a dedicated drive,
- a storage pocket drive Spt-Ant for said storage pockets,
- a set of fixed-location transfer sites in the form of fixed-location "transfer pockets" which are used as intermediate stores for the improved radix sorting method,
- a set of upper pick-up units oAe.1, oAe.2, . . . , wherein the upper pick-up units are configured without a dedicated drive and are rotatably fastened to a holding device Hv,
- a central drive system oAe-Ant for the driveless upper pick-up units oAe.1, oAe.2, . . . ,
- a set of lower pick-up units uAe.1, uAe.2, . . . , without a dedicated drive, each lower pick-up unit comprising an upwardly open container,
- a transport device with a central drive Beh-Ant for the lower pick-up units uAe.1, uAe.2, . . . , the lower pick-up units being connected, together with the containers, to the transport device or standing on the transport device and being transported by the transport device along a closed horizontal container conveying path, and
- a container changing station with a container conveyor Zuf-Beh and a container removal system Weg-Beh which removes filled containers from the container conveying path and feeds empty containers into the container conveying path.

In the example of FIG. 1, both the conveying devices ZE.1, ZE.2, the two cameras Ka.1, Ka.2 and the two feeding-in stations E-E.1, E-E.2 each operate in parallel.

The containers are transported in the transport direction T-Beh, and the storage pockets are transported in the transport direction T-Spt.

Each sorting plan allocates a pick-up unit and, in one embodiment, also a fixed-location transfer site to each sorting criterion value (each delivery address) arising. As a rule, a plurality of sorting criterion values is assigned to the same pick-up unit.

It is possible for a plurality of conveying devices to operate in parallel. The conveying devices ZE.1, ZE.2 of FIG. 1 operate in parallel. Each conveying device ZE.1, ZE.2 is able to use its separator to separate a stack of flat mail items assigned to said separator. The separated mail items are distributed among the feeding-in stations E-E.1, E-E.2. Each feeding-in station E-E.1, E-E.2 is able to place each mail item into a holding component, e.g. into a storage pocket. Preferably, each holding component accepts only one mail item at each time point. It is possible for a holding component to be re-used and to accept different mail items one after another.

The storage pocket drive Spt-Ant is able to transport the holding components in the form of storage pockets. The guide device holds and guides the storage pockets during this transportation to a closed horizontal storage pocket conveying path. For example, the storage pockets hang on two rails and are pulled by means of a transfer means, for example, by means of a chain. The storage pocket drive Spt-Ant pulls this transfer means and thereby moves the storage pockets continuously along the rails in a transport direction.

Each transportable storage pocket can be brought into a transfer position in relation to each fixed-location transfer pocket. In this transfer position, each mail item slides vertically or obliquely downwardly out of the storage pocket into the transfer pocket due to gravity when the flap of the storage pocket is opened.

Each upper pick-up unit and each lower pick-up unit can be brought into a transfer position in relation to each transfer pocket used. With the flap of the transfer pocket open, the mail items slide vertically or obliquely downwardly out of the transfer pocket onto or into the pick-up unit in the transfer position.

Both each storage pocket and each transfer pocket has an unloading mechanism in order to unload the content of the storage pocket/transfer pocket downwardly. For example, the base of the pocket has a flap which is rotatably connected to a side wall of the pocket. A lever at this flap can be actuated from outside and opens the flap against the force of a spring or a piston. Also possible is an actuator in the form of a fixed-location magnet which opens the flap from outside. With the flap open, the mail items from the pocket slide vertically or obliquely downwardly due to gravity. Due to the kinetic energy, the path of a falling mail item describes a section of a downwardly open parabola.

Figure 2:
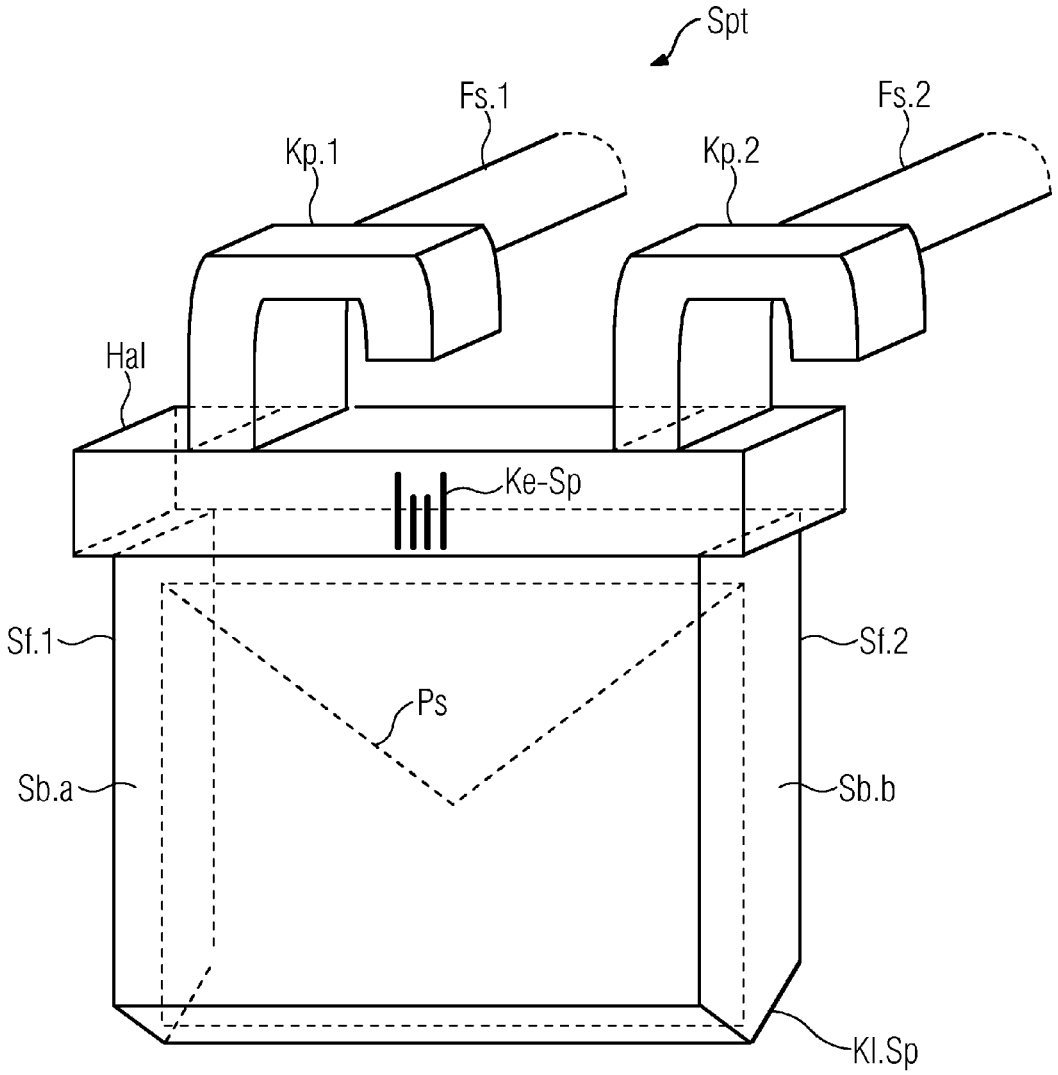
FIG. 2 is a schematic illustration of a storage pocket that is used.

FIG. 2 shows, by way of example, a storage pocket Spt. The storage pocket Spt is suspended by means of two hook-shaped coupling elements Kp.1 and Kp.2 from two parallel guide rails Fs.1, Fs.2 of the guide device. The two coupling elements K.1, K.2 are rigidly connected to a mechanical holder Hal. In another embodiment, a machine-readable identifier Ke-Sp of the storage pocket Spt is mounted on the holder Hal. This identifier Ke-Sp in the form of a bar code distinguishes this storage pocket Spt from all the other storage pockets of the sorting plant.

The storage pocket Spt holds a flat mail item Ps in the upright position in a space which is enclosed by the two planar vertical side surfaces Sf.1, Sf.2. The space is also delimited by the two narrow side regions Sb.a, Sb.b. A mail item is inserted through an opening in the side region Sb.b into the storage pocket Spt. In order to empty the storage pocket Spt, a two-winged flap K1.Sp at the base of the storage pocket Spt is opened. The mail item slides downwardly under the effect of gravity. In FIG. 2, the flap K1.Sp is shown in the closed position.

Figure 3:
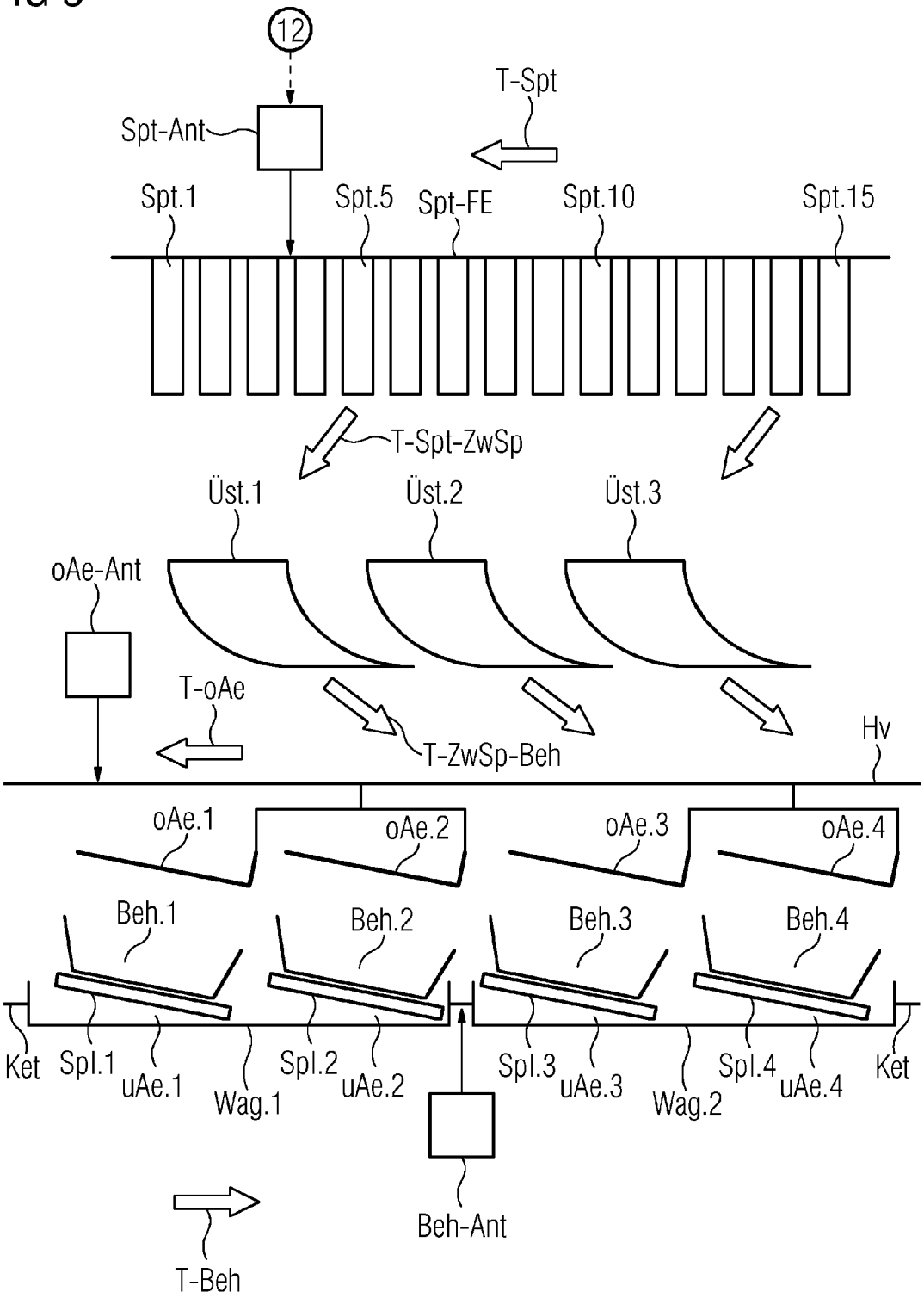
FIG. 3 is a side view of a plurality of storage pockets, a plurality of transfer pockets, a plurality of upper pick-up units and a plurality of lower pick-up units of the sorting plant.

FIG. 3 shows, by way of example, a side view of the moving storage pockets, the fixed-location transfer pockets, the moving upper pick-up units and the moving lower pick-up units with placement sites for containers in four planes lying over one another. Also shown are:

- a series of storage pockets Spt.1, . . . , Spt.5, . . . , Spt.15 which hang from a storage pocket guide device Spt-FE and are transported in the transport direction T-Spt, wherein the side surfaces of these storage pockets are arranged perpendicular to the drawing plane,
- three fixed-location transfer sites Üst.1, Üst.2, Üst.3 in the form of transfer pockets,
- four upper pick-up units oAe.1, oAe.2, oAe.3, oAe.4,
- four placement sites Spl.1, Spl.2, Spl.3, Spl.4 for containers, and
- four upwardly open containers Beh.1, Beh.2, Beh.3, Beh.4.

The storage pockets Sp.1, . . . , Sp.15 are situated in the upper layer and thereunder are the transfer pockets Üst.1, Üst.2, . . . , and then the upper pick-up units oAe.1, oAe.2, . . . , and in the lowest layer, the lower pick-up units uAe.1, uAe.2, . . . .

Each of the containers Beh.1, Beh.2, Beh.3, Beh.4 is situated on a respective placement site Spl.1, Spl.2, Spl.3, Spl.4. In the exemplary embodiment, two placement sites are mounted on each wagon. The placement sites Spl.1, Spl.2 are mounted on the wagon Wag.1. The placement sites Spl.3, Spl.4 are mounted on the wagon Wag.2. The placement site Spl.1 and the container Beh.1 together constitute the lower pick-up unit uAe.1. The placement site Spl.2 and the container Beh.2 on the placement site Spl.2 together constitute the lower pick-up unit uAe.2.

As FIG. 3 shows, the containers Beh.1, Beh.2, Beh.3, Beh.4 are placed on the placement sites Spl.1, Spl.2, Spl.3, Spl.4 obliquely inclined and the support surfaces are obliquely inclined such that the objects in the containers Beh.1, Beh.2, . . . , slide downwardly in the transport direction T-Beh in which the containers are transported. By this means, flat objects lying in the containers Beh.1, Beh.2, . . . , are oriented toward the front side wall of the container, seen in the transport direction T-Beh.

Also shown in FIG. 3 is the direction T-Spt-ZwSp in which the mail items slide out of the storage pockets Spt.1, Spt.5, . . . . Also shown is the direction T-ZwSp-SAus in which the mail items slide out of the fixed-location transfer sites Üst.1, Üst.2, . . . , to the upper pick-up units oAe.1, oAe.2, . . . , or into the containers Beh.1, Beh.2, . . . , of the lower pick-up units uAe.1, uAe.2, . . . . In the situation shown in FIG. 3, the upper pick-up units oAe.1, oAe.2, . . . , are in the pick-up position. The lower pick-up units uAe.1, uAe.2, . . . , are arranged in the shadow of the upper pick-up units oAe.1, oAe.2, . . . .

Furthermore, the drive Spt-Ant for the storage pockets and the drive Beh-Ant for the lower pick-up units uAe.1, uAe.2 and the drive oAe-Ant for the upper pick-up units oAe.1, oAe.2, . . . , are indicated in FIG. 3. The drive Beh-Ant pulls the wagons Wag.1, Wag.2 by means of a chain Ket in the direction T-Beh. The wagons Wag.1, Wag.2, . . . , do not have their own drive. The transfer sites Üst.1, Üst.2, . . . , are arranged locally fixed.

In the exemplary embodiment, each upper pick-up unit oAe.1, oAe.2, . . . , possesses a flat pick-up element and a stop wall. The pick-up element and the stop wall are firmly mechanically connected to one another as a horizontal edge and form—seen in a viewing direction parallel to the edge between the pick-up element and the stop wall—an L-shape. Each upper pick-up element can be brought into a pick-up position in which the pick-up element and the stop wall of an upper pick-up unit are both obliquely inclined. By this means, a mail item lies on the flat pick-up element and can slide obliquely downwardly until the mail item meets the stop wall. The pick-up element and the stop wall prevent further movement of the mail item. In this way, the upper pick-up unit holds the flat mail item and is able to transport the mail item. A plurality of mail items which pass one after the other to the same upper pick-up unit is stacked on the upper pick-up unit and, in the process, is oriented toward the stop wall.

The upper pick-up units are configured without a dedicated drive and are transported by the central drive oAe-Ant along a guide device. In another embodiment, the upper pick-up units are transported along a closed conveying path, specifically always in the same direction T-oAe on this conveying path. The upper pick-up units slide along at least one guide rail and are thus also guided on a closed conveying path. An engaging part connects at least one upper pick-up unit to this guide rail in each case. The sorting plant has a plurality of these engaging parts. Preferably, a plurality, for example two or three, of the upper pick-up units is connected to the same engaging part and together constitutes a pick-up unit module. The engaging part comprises a connecting member and a transverse support. The connecting member slides in the guide rail. For example, three upper pick-up units of the pick-up unit module are pivotably connected to the transverse support.

The drive pulls an engaging part and thus the upper pick-up units on this engaging part, along the guide rail. For example, each pick-up unit module is connected to the central drive via a chain or another transmission means.

Figure 4:
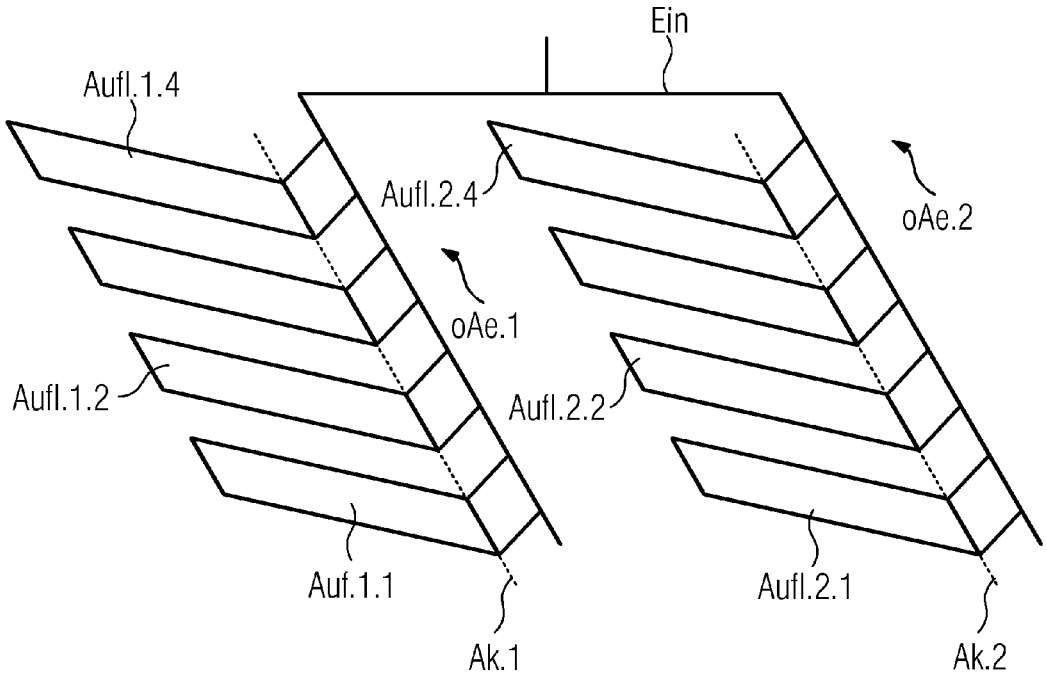
FIG. 4 shows two upper pick-up units linked to one another.

FIG. 4 shows, by way of example, an engaging part Ein to which two upper pick-up units oAe.1, oAe.2 are fastened. Each upper pick-up unit oAe.1, oAe.2 has the form of a fork having a plurality of rod-shaped elements ("prongs") Aufl.1.1, Aufl.1.2, . . . , Aufl.2.1, Aufl.2.2. The upper pick-up units oAe.1, oAe.2 of FIG. 4 are pivotably connected to the engaging part Ein.

In one embodiment, a central drive acts upon a transmission means, for example, a chain. This transmission means acts, in turn, on the engaging parts and pulls the engaging parts along the guide rail. In another embodiment, a plurality of upper pick-up units is also connected into one pick-up unit module. This pick-up unit module comprises a dedicated drive which drives at least one wheel of the engaging part. This wheel runs in the guide rail.

The closed horizontal conveying path along which the upper pick-up units are transported necessarily has curved sections. Since the pick-up elements are inclined, the pick-up elements of two adjacent upper pick-up devices overlap at times during transport along a curved section—as seen from above—without touching during transport along the curved section and therefore also without tilting.

In another embodiment, each upper pick-up unit can be brought into a position in which the flat pick-up element is arranged approximately horizontally and into a position in which said pick-up element is arranged approximately vertically. The pick-up element can be rotated about a horizontal rotation axis relative to the engaging part, so that the pick-up element can be folded up and down in the manner of a cinema seat. If the pick-up element is in the horizontal position, then the upper pick-up unit is in the pick-up position or in an unloading position. In the unloading position, all the objects can be removed or slide downwardly from the flat pick-up elements. When the pick-up element is in the vertical position, the upper pick-up unit is in the park position. This embodiment of the park position saves floor space ("footprint") in comparison with a non-pivotable pick-up unit because an upper pick-up unit situated in the park position takes up less floor space.

In one embodiment, an upper pick-up unit is either in the pick-up position, in the park position or in an unloading position. In another embodiment, the park position—or the pick-up position—also functions as the unloading position.

In another embodiment, the closed conveying path along which the upper pick-up units are transported, comprises at least one transfer section and at least one unloading section. Arranged above the transfer section is at least one fixed-location transfer pocket. Preferably, each transfer pocket Üst.1, Üst.2, . . . , is situated above a transfer section. Only when an upper pick-up unit is situated in a transfer section and in the pick-up position can this upper pick-up unit be brought into a transfer position in relation to a transfer pocket above the transfer section. Situated alongside each unloading section is an unloading station which takes mail items from an upper pick-up unit when said upper pick-up unit is situated in the unloading section and in the pick-up position which functions as the unloading position.

This embodiment makes it unnecessary to bring an upper pick-up unit into a special unloading position. Rather, a mail item slides onto the upper pick-up unit whilst said upper pick-up unit is situated in the pick-up position. The upper pick-up unit remaining in the pick-up position is transported to an unloading station and is unloaded there without being pivoted for the purpose of unloading. The pick-up position therefore also functions as the unloading position.

In another embodiment, the upper pick-up unit is pivoted out of the pick-up position into the unloading position once the upper pick-up unit has received mail items. The upper pick-up unit situated in this unloading position is then unloaded by an unloading station. For example, the pick-up element of the upper pick-up unit is in an approximately horizontal position and also lies obliquely inclined when the pick-up unit is either in the pick-up position or the unloading position. In the pick-up position, the pick-up element is slightly obliquely inclined toward the stop wall. In the unloading position, however, the pick-up element is obliquely inclined away from the stop wall. This pick-up element, however, is positioned approximately vertically when the pick-up unit is situated in the park position.

Preferably, each upper pick-up unit is guided by a guide device with at least three guide rails. The three guide rails form—seen parallel to the transport direction—the corners of a triangle, preferably an equilateral triangle. This guide device with at least three guide rails constitutes a closed conveying path along which the upper pick-up units slide. The engaging part described above has the form—seen in the transport direction and in a plane perpendicular to the transport direction—of a parallelogram with two shorter and two longer sides. The engaging part hangs from the guide device with at least three guide rails so that a shorter part faces upwardly and is connected at least at each of two sites to one of the at least three guide rails. The four sides of this parallelogram are connected to one another in articulated manner so that the angles between these four sides can be changed. The upper shorter edge of the parallelogram slides in the guide rail. A single upper pick-up unit or a transverse support with a plurality of upper pick-up units is fastened to the lower shorter edge. The engaging part and thus the upper pick-up unit are subject to restricted guidance by this design. It is achieved by suitable shaping of the three-dimensional guide device that the engaging part is rotated during movement thereof along the guide rails. This rotation has the effect that the engaging part brings the upper pick-up unit on the transverse support into the pick-up position or into the park position, whilst the upper pick-up unit is transported along the closed conveying path. This embodiment therefore realizes a restricted guidance and a forced transfer of the upper pick-up unit from the park position into the pick-up position and vice versa. A dedicated drive for pivoting an upper pick-up unit is rendered unnecessary.

The sorting plant has an unloading station for the upper pick-up units. This unloading station is able to unload an upper pick-up unit when said upper pick-up unit is in the unloading position.

In another embodiment, the pick-up element of each upper pick-up unit has a plurality of recesses such that the pick-up element has the form of a fork with a plurality of prongs (see FIG. 4). The unloading station has at least one flat unloading element. Said unloading element comprises a plurality of projections with recesses between said projections so that the unloading element also has the form of a fork. Said unloading element engages with the projections (prongs) thereof into corresponding recesses of the pick-up element and takes the mail items that are lying on the pick-up element from this support element. In this process, the unloading element lifts the mail items from the pick-up element.

In another embodiment, every lower pick-up unit comprises a moveably configured placement site for a container wherein this container has a rectangular base and a plurality of side walls. Said container is upwardly open. The wagon with this container placement site can be transported along a closed conveying path. The container placement site can also be rotated about a horizontal rotation axis arranged perpendicularly to the transport direction and thus pivot from a horizontal position into the obliquely inclined position of FIG. 3 and back again.

The transport device is subdivided into a plurality of sections. Each section comprises at least one container holder for one container. This container holder belongs to a placement site and is preferably configured such that a container stands on the container holder, is held by the container holder and the base of the container is obliquely inclined. By this means, the flat mail items which lie in the container are oriented to the lower side wall of the inclined container. Preferably, the lower side wall is that which, seen in the transport direction, is arranged at the front. The transport device is able to move this container holder along a closed container conveying path. In one embodiment, as shown in FIG. 3, a container holder comprises two container placement sites, that is two mutually connected lower pick-up units.

In the exemplary embodiment, a maximum pick-up capacity is pre-defined for the upper pick-up units. This maximum pick-up capacity is stipulated, for example, as the maximum number or the maximum overall thickness or the maximum overall weight of the mail items which the upper pick-up unit is able to accommodate at once. Each upper pick-up unit is therefore configured to be able to accept mail items until the maximum pick-up capacity is reached. This maximum pick-up capacity is defined, for example, by the space available between a fixed-location transfer site and an upper pick-up unit when the upper pick-up unit is situated in the pick-up position and in the transfer position in relation to said transfer site. The flat design of the upper pick-up units is adapted to the available space. Each lower pick-up unit is able to accommodate significantly more mail items than the maximum pick-up capacity—or, more generally: has a pick-up capacity that is greater than the maximum pick-up capacity of an upper pick-up unit. Preferably, the pick-up capacity of each container is a multiple of this maximum pick-up capacity.

In the exemplary embodiment, each transfer site has a sensor which determines whether the transfer site is empty or is filled with mail items. With the aid of this sensor, following opening of the flap, it is determined whether the transfer site is now actually empty or whether, despite the open flap, mail items are still situated in the transfer site, which indicates a backup of mail items or an error during opening of the flap.

In one embodiment, each upper pick-up unit has a fill level sensor. Said sensor measures, for example, optically or by means of a sensing lever, whether the current fill level is still below a pre-determined limit, for example, below the pre-determined maximum pick-up capacity or is above said limit. The sensor emits a signal if the limit has been reached or exceeded. The filled upper pick-up unit is no longer re-selected until the upper pick-up unit has been emptied. In another embodiment, each lower pick-up unit also has a fill level sensor which monitors the fill level in a container or on a section of an endless conveying belt.

In another embodiment, the fill level in each pick-up unit is predicted by computer. The thickness of each mail item is measured. It is recorded which mail item is output into or onto which pick-up unit. The thicknesses of all the mail items output since the last emptying or since another reference event into or onto the same pick-up unit are totaled. By this means, the fill level is predicted by computer.

Preferably, the actual fill level is measured in order to correct the predicted fill level and in order to provide a reference value for further predictions. Preferably, at least one fixed-location sensor measures the actual fill level of a pick-up unit. Preferably, a first fixed-location sensor measures the fill levels of the upper pick-up units and a second fixed-location sensor measures the fill levels of the lower pick-up units. Each pick-up unit is transported past one of said fixed-location sensors and the sensor measures optically, or by other means, and contactlessly, the actual fill level in or on the pick-up unit. The prediction by computer described above is then based on the optically measured actual fill level and on the thicknesses of those mail items which have been brought into or onto this pick-up unit since the last measurement. If the optical sensor determines that an upper pick-up unit is situated in the park position, then it is automatically concluded that the current fill level of this upper pick-up unit is zero, that is, that the upper pick-up unit is empty.

As described below, the lower pick-up units are used for outgoing sorting wherein all the mail items arriving are distributed among w sorting centers and w1 further sorting destinations. During the outgoing sorting, the mail items are sorted in a single sorting run among w+w1 different sorting destinations. The lower pick-up units are also used in the incoming sorting, in order to distribute the mail items to a delivery region W(k) among the delivery districts of this delivery region W(k).

In the sequential sorting, however, the upper pick-up units are used. In the sequential sorting, in each case, a sequence is created among the mail items for each delivery district Z(i). For each individual sequential sorting operation, markedly fewer mail items are to be sorted since only a few mail items (typically, less than ten) are to be delivered to each individual sorting destination. For outgoing sorting and for incoming sorting, however, each sorting center or each delivery district forms its own sorting destination, so that many mail items are to be transported to the same sorting destination and large pick-up units are required. In this embodiment, therefore, for outgoing sorting and for incoming sorting, only the lower pick-up units and, for sequential sorting, only the upper pick-up units are used.

In each sorting run, the following steps are carried out for a mail item to be sorted:

- The mail item is fed, together with a plurality of other mail items, to a conveying device ZE.1, ZE.2 ("feeder") and transported to the singulator.
- The singulator separates the stack of flat mail items fed in and generates a stream of mail items spaced apart from one another.
- The mail item is transported, aligned at the lower edge thereof and standing upright, past the measuring device to the feeding-in station E-E.1, E-E.2.
- The camera Ka.1, Ka.2 of the measuring device generates at least one computer-accessible image of the mail item. This image shows the delivery address, with the identification of which the mail item is provided, and/or a logo or other identification of a sender.
- The image evaluating unit Bae.1, Bae.2 of the measuring device evaluates this image firstly in order to decipher an identification of a destination address on the mail item.
- Secondly, the measuring device measures two dimensions (length and height) of the mail item, for which purpose, in one embodiment, the image is also evaluated.
- The thickness of the mail item is contactlessly measured.
- The feeding-in station E-E.1, E-E.2 feeds the mail items transported standing upright into a storage pocket. The time period for transporting the mail items as far as the feeding-in station E-E.1, E-E.2 and bringing said items into a storage pocket is also available for evaluating the image, since the sorting criterion value of the mail item does not yet need to be known.

Subsequently, an upper and a lower pick-up unit is automatically selected. In the exemplary embodiment, initially the selection unit AE automatically selects for the mail item a pick-up unit and then, depending on the selected pick-up unit, a fixed-location transfer site (transfer pocket). In order to select a pick-up unit, the selection unit AE applies the computer-accessible sorting plan for this sorting run to the delivery address as determined for the mail item. The pick-up unit is selected based on the sorting plan, depending on the sorting criterion value.

The transfer site is selected such that the transport from the feeding-in station to the selected transfer site and from this transfer site to the selected pick-up unit is as short as possible.

The storage pocket with the mail item is transported by means of the guide device and the conveying drive along the storage pocket conveying path to the selected transfer site, until the storage pocket is situated in a transfer position in relation to the selected transfer pocket Üst.1, Üst.2, . . . .

The unloading mechanism of the storage pocket is opened and the mail item slides downwardly out of the storage pocket into the selected transfer pocket Üst.1, Üst.2, . . . . Due to the inertia of the mass, the flight path of the mail item follows a section of a downwardly open parabola. The flight ends when the mail item meets the front side wall—seen in the transport direction of the storage pocket—of the transfer pocket Üst.1, Üst.2, . . . , and is stopped by the impact.

The selected pick-up unit is brought into a transfer position in relation to this stationary transfer pocket, the pick-up unit being moved in relation to the fixed-location filled transfer pocket.

The unloading mechanism of the transfer pocket is opened and the mail item slides downwardly out of the transfer pocket into the selected pick-up unit, whilst this pick-up unit is transported past beneath the transfer pocket.

In this embodiment, the pick-up units therefore function as the sorting terminals of the sorting plant. The fixed-location transfer pockets function as the transfer sites and as intermediate stores.

In the exemplary embodiment, the sorting plant according to the solution can be operated in two modes, specifically either in an upper mode or in a lower mode. In the upper mode, exclusively the upper pick-up units are selected and used and, in the lower mode, exclusively the lower pick-up units. If the sorting plant is switched into the upper mode, then all the upper pick-up units are brought into the pick-up position before a mail item is output into a pick-up unit. In the upper mode, the selection unit selects an upper pick-up unit for each mail item. The lower pick-up units are not needed if the sorting plant is operated in the upper mode. It is possible to replace filled containers on placement sites (lower pick-up units) with empty containers while the sorting plant operates in the upper mode. It is also possible to leave containers from the lower pick-up units in the sorting plant. In this way, the sorting plant also functions as an intermediate store for lower pick-up units.

If the sorting plant is switched into the lower mode, then all the upper pick-up units are brought into the park position before a mail item is output into a pick-up unit. The upper pick-up units are not selected and are therefore not used if the sorting plant is operated in the lower mode. It is also possible to switch the upper pick-up units initially into an unloading position when the sorting plant is switched into the lower mode.

Both in the park position and also in this unloading position, the upper pick-up units do not prevent the process that a mail item slides out of a transfer site (transfer pocket) into a selected lower pick-up unit. If an upper pick-up unit is situated in the unloading position, mail items can be removed from this upper pick-up unit. The process of removing mail items from an upper pick-up unit can be carried out overlapping in time with the process of the sorting plant being operated in the lower mode and mail items being distributed among the lower pick-up units.

If the sorting plant is switched into the upper mode, then all the upper pick-up units are pivoted into the pick-up position. The pick-up elements of the upper pick-up units are then situated between the transfer sites (transfer pockets) and the lower pick-up units. An object which slides downwardly out of a transfer pocket reaches an upper pick-up unit and cannot reach a lower pick-up unit. Each lower pick-up unit lies effectively in the shadow of the upper pick-up units situated in the pick-up position.

As described above, an upper pick-up unit is able to accommodate significantly fewer mail items than a lower pick-up unit. However, an upper pick-up unit can be more easily unloaded when the pick-up unit is in an unloading position. Conversely, although a lower pick-up unit can accommodate more mail items than an upper pick-up unit, it cannot be unloaded so rapidly.

Therefore, the sorting plant can be operated in the upper mode if rapid unloading is important. For that reason, the sorting plant is operated in the upper mode in one embodiment wherein the sorting plant sorts mail items in delivery route order in two sorting runs of a sequential sorting process. The plant is operated in upper mode in each sorting run of the sequential sorting process.

In another embodiment, in a sequential incoming sorting process with two sorting runs, the sorting plant according to the solution only carries out only the first sorting run in the upper mode. If the incoming sorting consists of more than two sorting runs, then the sorting plant carries out every sorting run except for the last sorting run in the upper mode. However, the sorting plant carries out the outgoing sorting and the incoming sorting in the lower mode. In another embodiment, the sorting plant also carries out the last sorting run of the sequential sorting in the lower mode.

REFERENCE SIGNS

| Reference sign | Meaning |
|---|---|
| AE | Selection unit, automatically selects an upper or a lower pick-up unit for an object depending on the sorting criterion value |
| Ak.1, Ak.2 | Stop walls of the upper pick-up units oAe.1, oAe.2 |
| Aufl.1.1, . . . , Aufl.2.1, . . . | Fork-shaped support elements of the upper pick-up units oAe.1, oAe.2 |
| Bae.1, Bae.2 | Image evaluation units, decipher destination point identifications |
| Beh.1, Beh.2, . . . | Containers on the placement sites Spl.1, Spl.2 of the lower pick-up units uAe.1, uAe.2, . . . |
| Beh-Ant | Drive for the wagons Wag.1, Wag.2 of the lower pick-up units uAe.1, uAe.2, . . . |
| Ds-Spl | Data store with computer-evaluatable sorting plans |

-continued

| Reference sign | Meaning |
|---|---|
| E-E.1, E-E.2 | Parallel-operating feeding-in stations, feed mail items into the storage pockets Spt.1, Spt.2, . . . |
| Ein | Engaging part, holds the upper pick-up units oAe.1, oAe.2 |
| Fs.1, Fs.2 | Parallel guide rails for storage pockets |
| Hal | Holder for storage pocket Spt, holds the side surfaces Sf.1, Sf.2 |
| Hv | Transportable holding device for the pivotable upper pick-up units oAe.1, |
| Ka.1, Ka.2 | Cameras, generate computer-evaluatable images of mail items transported standing upright |
| Ke-Sp | Machine-readable identifier for the storage pocket Spt |
| Ket | Chain for pulling the wagons Wag.1, Wag.2 |
| Kp.1, Kp.2 | Hook-shaped coupling elements of the storage pocket Spt |
| M | Number of sorting destinations for the sequential sorting |
| N | Number of sorting terminals in the sorting plant being used |
| oAe.1, oAe.2, | Upper pick-up units |
| oAe-Ant | Drive for the upper pick-up units oAe.1, oAe.2, . . . |
| Ps | Flat mail item in the storage pocket Spt |
| Sb.a, Sb.b | Narrow side regions of the storage pocket Spt |
| SE | Control unit, controls, inter alia, the drives oAe-Ant, Beh-Ant and Spt-Ant |
| Sf.1, Sf.2 | Side surfaces of the storage pocket Spt, hang from the holder Hal |
| Spt.1, Spt.2, | Movable holding components for flat mail items in the form of storage pockets |
| Spl.1, Spl.2, | Placement sites for containers Beh.1, Beh.2, . . . |
| Spt-Ant | Central drive for storage pockets Spt.1, Spt.2, . . . |
| Spt-FE | Guide device for storage pockets Spt.1, Spt.2, . . . |
| T-Beh | Transport direction in which the containers Beh.1, Beh.2, . . . are transported |
| T-Spt | Transport direction in which the containers Spt.1, Spt.2, . . . are transported |
| T-Spt-ZwSp | Transport direction in which the mail items from the storage pockets slide into the fixed-location transfer sites Üst.1, Üst.2, |
| T-ZwSp-Beh | Transport direction in which the mail items from the transfer sites Üst.1, Üst.2, . . . , slide into the pick-up units |
| uAe.1, uAe.2, . . . | Lower pick-up units with placement sites Spl.1, Spl.2, . . . for containers Beh.1, Beh.2, . . . |
| Üst.1, Üst.2, | Fixed-location transfer sites in the form of transfer pockets |
| Ver.1, Ver.2 | Separator ("singulator") of the conveying device ZE.1, ZE.2 |
| w | Number of delivery regions |
| Wag.1 | Wagon with placement sites Spl.1, Spl.2 |
| Wag.2 | Wagon with placement sites Spl.3, Spl.4 |
| Weg-Beh | Removal device for filled containers |
| ZE.1, ZE.2 | Conveying devices ("feeders") operating in parallel with the singulator Ver.1 or Ver.2 |
| Zuf-Beh | Conveying device for empty containers |

The invention claimed is:

1. A sorting plant for sorting objects according to a predefined sorting criterion, the sorting plant comprising:

a set of transfer sites having a plurality of transfer sites;

a set of pick-up units with a plurality of lower pick-up units and a plurality of upper pick-up units;

a holding device to which said plurality of upper pick-up units is fastened, each of said upper pick-up units pivotably connected to said holding device such that said upper pick-up units can be brought into a pick-up position or a park position;

a measuring device configured to measure, for an object to be sorted, a value that the predefined sorting criterion assumes for the object;

a selection unit configured to select, for the object to be sorted, depending on a measured sorting criterion value of the object, one of said upper pick-up units or one of said lower pick-up units;

a conveying transport device for transporting the object to be sorted to one of said transfer sites;

a pick-up unit transport device;

each of said transfer sites, said upper pick-up units and said lower pick-up units configured to accommodate at least one object to be sorted;

one of said upper pick-up units being disposed between said set of transfer sites and said lower pick-up units at least when said upper pick-up unit is in the pick-up position;

each of said upper pick-up units and each of said lower pick-up units can be brought respectively into one transfer position in relation to each of said transfer sites;

the object to be sorted can be brought out of one of said transfer sites into one of said upper pick-up units if said one upper pick-up unit being disposed in the transfer position in relation to said one transfer site;

the object to be sorted can be brought out of said transfer site into one of said lower pick-up units if said one lower pick-up unit being disposed in the transfer position in relation to said transfer site and each of said upper pick-up units being disposed in the park position between said transfer site and one of said lower pick-up units;

said pick-up unit transport device configured for the object to be sorted, to carry out a relative movement of said upper or said lower pick-up unit selected for the object in relation to said transfer site, to which the object was transported in such a way that said selected upper or lower pick-up unit is situated, following the relative movement, in the transfer position in relation to said transfer site with the object; and the sorting plant configured to bring the object to be sorted from said transfer site to which the object was transported, into one of said set of pick-up units which is situated in the transfer position and has been selected.

2. The sorting plant according to claim 1, wherein a maximum pick-up capacity is pre-defined for said upper pick-up units and said pick-up units are configured such that a respective pick-up capacity of each of said upper pick-up units is smaller than or equal to the maximum pick-up capacity, and a respective actual pick-up capacity of each of said lower pick-up units is greater than the maximum pick-up capacity.

3. The sorting plant according to claim 1, wherein at least one of said upper pick-up units contains a support element and at least one stop wall, said one upper pick-up unit is configured such that when said one upper pick-up unit is in the pick-up position, the object picked-up by said one upper pick-up unit lies on said support element and rests against said stop wall.

4. The sorting plant according to claim 1, wherein at least one of said upper pick-up units is configured such that said one upper pick-up unit can be pivoted through a rotation in a rotation direction from the park position into the pick-up position, and can be pivoted from the pick-up position into the park position by a rotation in a contrary direction about a same rotation axis.

5. The sorting plant according to claim 1, wherein:

if all of said upper pick-up units are situated in the pick-up position, said set of transfer sites is situated above said upper pick-up units, and said upper pick-up units are situated above said lower pick-up units; and the sorting plant is configured such that the object to be sorted is able to slide out of said transfer site having the object vertically or obliquely downwardly into said upper or lower pick-up unit selected for the object.

6. The sorting plant according to claim 1, wherein:

said set of transfer sites is configured as a fixed-location device; and said holding device contains a guide device for said upper pick-up units;

said pick-up unit transport device configured to move said upper pick-up units along said guide device relative to said transfer sites being fixed location transfer sites; and said pick-up unit transport device is configured to move said lower pick-up units relative to said fixed location transfer sites.

7. The sorting plant according to claim 6, wherein:

said pick-up unit transport device is configured to move said upper pick-up units along said guide device of said holding device in a transport direction relative to said fixed-location transfer sites; and said pick-up unit transport device is configured to move said lower pick-up units in a contrary transport direction relative to said fixed-location transfer sites.

8. The sorting plant according to claim 1, wherein:

said selection unit is configured to select one of said transfer sites for each object to be sorted, depending on the measured sorting criterion value or on a physical property of the object; and said conveying transport device is configured to transport the object to be sorted to one of said transfer sites selected for the object.

9. A sorting method for sorting objects according to a pre-defined sorting criterion, which comprises the steps of:

providing a sorting plant and performing the sorting method via the sorting plant, the sorting plant containing:

a set of transfer sites having a plurality of transfer sites;

a holding device to which a plurality of upper pick-up units is fastened;

a set of pick-up units with a plurality of lower pick-up units;

each transfer site, each upper pick-up unit and each lower pick-up unit configured to accommodate at least one object to be sorted;

each of the upper pick-up units is pivotably connected to the holding device such that the upper pick-up units can be brought into a pick-up position and into a park position;

the upper pick-up units situated in the pick-up position are each situated between the set of transfer sites and the set of pick-up units;

performing the following steps for each of the objects to be sorted:

measuring a value that the pre-determined sorting criterion assumes for the object;

depending on a sorting criterion value of the object, automatically selecting either the upper pick-up unit or the lower pick-up unit;

transporting the object to a transfer site;

when the upper pick-up unit has been selected for the object to be sorted, performing the further steps of:

pivoting a selected upper pick-up unit into, or remains in, the pick-up position and is brought into a transfer position in relation to the transfer site to which the object was transported or remains in such a transfer position; and bringing the object out of the transfer site into the selected upper pick-up unit;

when the lower pick-up unit has been selected for the object to be sorted, performing the further steps of:

pivoting a selected lower pick-up unit into, or remains in, the transfer position in relation to the transfer site to which the object was transported;

bringing at least one of the upper pick-up units which is situated between the transfer site with the object and the selected lower pick-up unit, into the park position or remains in the park position; and bringing the object out of the transfer site into the selected lower pick-up unit.

10. The sorting method according to claim 9, wherein if all the upper pick-up units are disposed in the pick-up position, the set of transfer sites is situated above the upper pick-up units, and the upper pick-up units are situated above the lower pick-up units, and on the step of bringing the object to be sorted from the transfer site into the selected pick-up unit, the object slides vertically or obliquely downwardly out of the transfer site into the selected pick-up unit.

11. The sorting method according to claim 9, which further comprises:

before the sorting, bringing all of the upper pick-up units to the park position and for each of the objects, the lower pick-up unit is selected and used.

12. The sorting method according to claim 9, wherein before the sorting, all of the upper pick-up units are brought into the pick-up position, and for each of the objects, the upper pick-up unit is selected and used.

13. The sorting method according to claim 9, wherein a sequence among sorting criterion values which occur is pre-determined, and carrying out the further steps of:

selecting a same pick-up unit for a plurality of objects with different sorting criterion values;

distributing the objects among the plurality of transfer sites depending on the sorting criterion values; and subsequently emptying the transfer sites such that in a selected pick-up unit a series of objects is generated which corresponds to the pre-determined value sequence.

* * * * *